US008404976B2

(12) United States Patent
Telley et al.

(10) Patent No.: US 8,404,976 B2
(45) Date of Patent: Mar. 26, 2013

(54) FUSED WIRES

(75) Inventors: Sean P. Telley, Fort Wayne, IN (US); Christian W. Stacey, Fort Wayne, IN (US)

(73) Assignee: Fort Wayne Metals Research Products Corporation, Fort Wayne, IN (US)

( * ) Notice: Subject to any disclaimer, the term of this patent is extended or adjusted under 35 U.S.C. 154(b) by 234 days.

(21) Appl. No.: 12/694,779

(22) Filed: Jan. 27, 2010

(65) Prior Publication Data

US 2010/0243292 A1 Sep. 30, 2010

Related U.S. Application Data

(60) Provisional application No. 61/148,492, filed on Jan. 30, 2009.

(51) Int. Cl.
*H01B 7/00* (2006.01)

(52) U.S. Cl. ..... 174/115

(58) Field of Classification Search ..... 174/27, 174/113 R, 115
See application file for complete search history.

(56) References Cited

U.S. PATENT DOCUMENTS

| | | | | |
|---|---|---|---|---|
| 2,204,782 | A * | 6/1940 | Wermine | 156/55 |
| 2,828,234 | A | 3/1958 | Hengel et al. | |
| 3,005,739 | A | 10/1961 | Lang et al. | |
| 3,440,118 | A | 4/1969 | Obeda | |
| 4,215,529 | A | 8/1980 | Gerbracht | |
| 4,221,756 | A | 9/1980 | Piper et al. | |
| 4,368,214 | A | 1/1983 | Gillette | |
| 4,381,208 | A | 4/1983 | Baverstock | |
| RE31,477 | E * | 12/1983 | Marshall | 174/115 |
| 4,423,306 | A * | 12/1983 | Fox | 219/137.9 |
| 4,530,851 | A | 7/1985 | Shannon et al. | |
| 4,649,856 | A | 3/1987 | Shannon et al. | |
| 5,015,800 | A | 5/1991 | Vaupotic et al. | |
| 5,245,134 | A * | 9/1993 | Vana et al. | 174/117 F |
| 5,298,101 | A | 3/1994 | Babiel et al. | |
| 5,401,908 | A | 3/1995 | Rodeghero | |
| 6,057,511 | A * | 5/2000 | Ikeda et al. | 174/110 R |
| 6,273,977 | B1 * | 8/2001 | Harden et al. | 156/51 |
| 6,403,887 | B1 * | 6/2002 | Kebabjian et al. | 174/110 R |
| 6,512,536 | B1 | 1/2003 | Ross | |
| 7,131,308 | B2 | 11/2006 | McCullough et al. | |
| 2006/0021772 | A1 * | 2/2006 | Dellagala et al. | 174/27 |

FOREIGN PATENT DOCUMENTS

| | | | |
|---|---|---|---|
| DE | 2203531 | A1 | 7/1973 |
| DE | 3207823 | A1 | 9/1983 |
| DE | 9004477 | U1 | 8/1994 |
| EP | 0090315 | A2 | 10/1983 |
| EP | 2214177 | A3 | 8/2012 |
| FR | 1213161 | A | 1/1960 |
| FR | 2231081 | A1 | 12/1974 |
| GB | 2237442 | A | 5/1991 |
| JP | 2236915 | A | 9/1990 |

* cited by examiner

*Primary Examiner* — Chau Nguyen
(74) *Attorney, Agent, or Firm* — Faegre Baker Daniels

(57) ABSTRACT

A method for fusing a pair of insulated wires to one another, and a fused wire made by such method, in which the combined or major diameter of the fused wire equals, or very closely matches, the sum of the diameters of the individual wires prior to fusion. In the present method, a pair of wires, each having a coating of insulation that is substantially fully cured, are brought into close abutting contact with one another along a line contact, and thereafter pass through a heating device which heats the coatings above their a thermal transition point of at least one of the pair of wires to fuse the coatings of the wires together along the line contact.

21 Claims, 9 Drawing Sheets

110
30
20
112
112
20

100
35
20
32
34
20
90
35

$L_H$
40
46
35
22a, 22b
42
70
40
46

56
22a,22b
4
50
44
4
44
42
22a
22b
32
3
3

FUSED WIRES

CROSS REFERENCE TO RELATED APPLICATION

This application claims the benefit under Title 35, U.S.C. §119(e) of U.S. Provisional Patent Application Ser. No. 61/148,492, entitled METHOD FOR FUSING INSULATED WIRES, AND FUSED WIRES PRODUCED BY SUCH METHOD, filed on Jan. 30, 2009, the entire disclosure of which is hereby expressly incorporated herein by reference.

BACKGROUND OF THE INVENTION

1. Technical Field

The present disclosure relates to insulated wires and, in particular, relates to a method of fusing a pair of insulated wires together, and a fused wire made in accordance with such method.

2. Description of the Related Art

Insulated wires are well known for use in many applications, and are formed by coating a metal conductor wire with a coating of insulation material. The metal conductor wire may be an individual wire, or may be a strand made by twisting a plurality of individual metal wires together. Typically, the metal wires are coated by an extrusion process to form a coating or jacket of insulation material around the metal wire.

In some applications, it is desired to manufacture a dual conductor wire in which a pair of insulated metal conductor wires are joined. This dual conductor configuration physically separates, and electrically insulates, the metal conductor wires from one another. Some applications benefit from minimizing the space required to route conducting wires, and a dual conductor wire is generally more compatible with a smaller routing space as compared with two individually routed wires.

Medical applications, such as leads for cardiac rhythm management devices and neurostimulation devices, may require passage of wires through small anatomical channels. Such applications benefit from dual conductor wires, which facilitate passage of the wires through the channels and simplify layout and clamping of the wires before and during a surgical procedure.

One approach to manufacturing insulated dual conductor wires is by co-extruding the insulation material around the pair of conductor wires. However, co-extrusion has certain disadvantages and is not always a desirable method, particularly when forming dual conductor wires that need to be attached along a minimal, or line, contact such that the round cross sectional shapes of the individual insulation coatings of the individual wires is maintained.

In another method, a pair of metal conductor wires are each covered by a coating of insulation by separate extrusion processes. In one version of this method, the coated wires are placed in contact with one another soon after extrusion of the coatings, allowing residual heat from the extruded coatings to fuse the coatings of the wires together. In another version of this method, coated insulated wire pairs are first individually pre-heated, and are then subsequently brought into close contact with one another after heating such that the heated insulation coatings fuse together as the coatings set or cure.

With each of these methods, it is necessary to bring the coated wires as close to one another as possible while the insulation is heated and is not fully cured, and it is very difficult, if not impossible, to avoid deforming the insulation coatings as the wires are pressed together, such that a significant amount of the coating of one wire flows into or around, or blends into, the coating of the other wire, and vice-versa.

These processes tend to produce wires of the type shown in FIG. 1, in which an fused wire 10 made in accordance with the foregoing processes is shown. Fused wire 10 is formed from a pair of separate insulated wires 12*a* and 12*b* each including respective conductors 14*a* and 14*b* covered by insulation coating 16*a* and 16*b* and each having an initial diameter $D_A$, which diameters are shown partially in dashed lines. As may be seen in FIG. 1, when fused wire 10 is formed from a pair of wires 12*a* and 12*b* according to one of the above-described processes, significant overlap of the insulation coatings 16*a* and 16*b* of the wires 12*a* and 12*b* occurs, such that the resulting combined or major diameter $D_B$ of the dual fused wire 10 is significantly smaller than the combined initial diameters $D_A$ of the individual insulated wires 12*a* and 12*b* prior to formation of fused wire 10. In particular, the combined diameter $D_B$ of fused wire 10 is often less than 75% of the combined initial diameters $D_A$.

What is needed is a method of fusing a pair of insulated wires to one another, and a wire made in accordance with such method, which is an improvement over the foregoing.

SUMMARY OF THE INVENTION

The present disclosure provides a method for fusing a pair of insulated wires to one another, and a fused wire made by such method, in which the combined or major diameter of the fused wire equals, or very closely matches, the sum of the diameters of the individual wires prior to fusion. In the present method, a pair of wires, each having a coating of insulation that is substantially fully cured, are brought into close abutting contact with one another along a line contact, and thereafter pass through a heating device which heats the coatings above a thermal transition point of at least one of the pair of wires to fuse the coatings of the wires together along the line contact.

Advantageously, by the present method, insulated wires can be brought together in a close contacting adjacent relationship to ensure that the coatings of the wires are just barely touching one another prior to any heat being applied to the wires. Subsequent heating ensures that the wires are fused only along a minimal line contact between the insulation coatings, thereby minimizing or preventing deformation of the insulation coatings of the wires while producing a bond strength between the individual coatings adequate to ensure that the pair remains firmly joined. The resulting fused wire has a low pull-apart strength and a high degree of retained integrity for the individual insulation coatings. The combined diameter of the fused wire equals, or very closely matches, the combined diameters of the individual wires prior to fusion.

In one form thereof, the present invention provides a fused wire, including a first wire including a first metal conductor surrounded by a first coating of insulation, the first wire having a first diameter $D_1$; a second wire including a second metal conductor surrounded by a second coating of insulation, the second wire having a second diameter $D_2$; and the first and second wires fused together along a line contact between the first and second coatings to form the fused wire, the fused wire having a major diameter $D_3$, the wire further having a value Fusion % according to the following formula:

$$\text{Fusion }\% = [D_3/(D_1+D_2)]\times 100\% \quad \text{(I)}$$

wherein Fusion % is between 75% and 99.5%.

In another form thereof, the present invention provides a method of fusing a pair of coated wires, the method including the steps of: providing at least first and second wires, each wire including a metal conductor surrounded by a coating of insulation; paying the wires outwardly from at least one spool; aligning the wires in abutting contact with one another along a line contact between the coatings of the wires; and heating the wires while maintaining the wires in abutting contact with one another along the line contact to a temperature sufficient to fuse the coatings of the wires together along the line contact.

In yet another form thereof, the present invention provides a medical device, the medical device including a first wire electrically coupled to the medical device, the first wire including a first metal conductor surrounded by a first coating of insulation, the first wire having a first diameter $D_1$; a second wire electrically coupled to the medical device, the second wire including a second metal conductor surrounded by a second coating of insulation, the second wire having a second diameter $D_2$; and at least a portion of the first and second wires fused together along a line contact between the first and second coatings to form the fused wire, the fused wire having a major diameter $D_3$, the fused wire further having a value Fusion % according to the following formula:

$$\text{Fusion }\% = [D_3/(D_1+D_2)]\times 100\% \quad \text{(I)}$$

wherein Fusion % is between 75% and 99.5%, the first wire and the second wire separable along the line contact.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

The exemplifications set out herein illustrate embodiments of the invention, and such exemplifications are not to be construed as limiting the scope of the invention in any manner.

DETAILED DESCRIPTION

1. Fused Wire Configurations

Figure 1A:
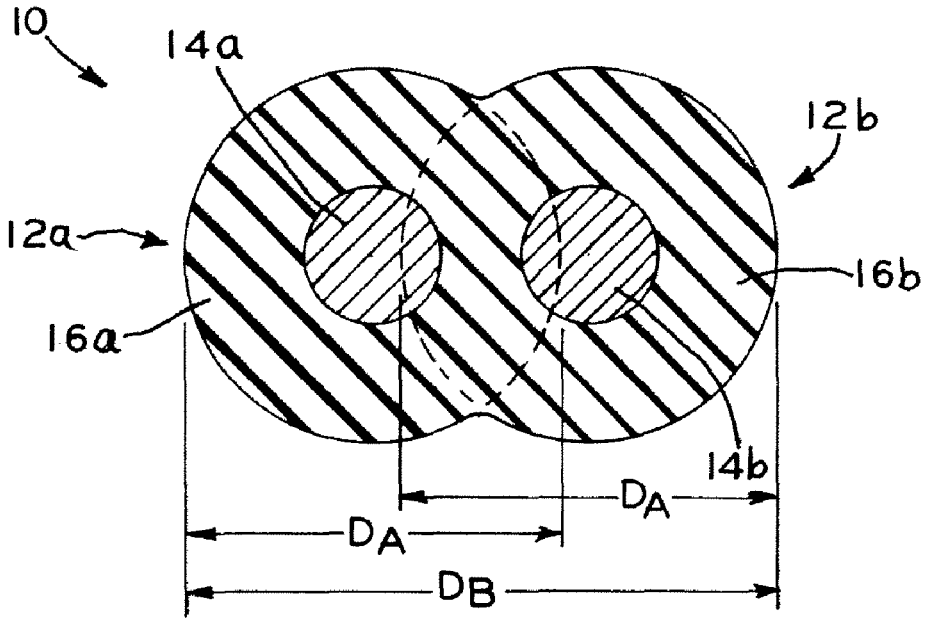
FIG 1A PRIOR ART
FIG. 1A is a sectional view of a fused wire made according to a known process.
Figure 1B:
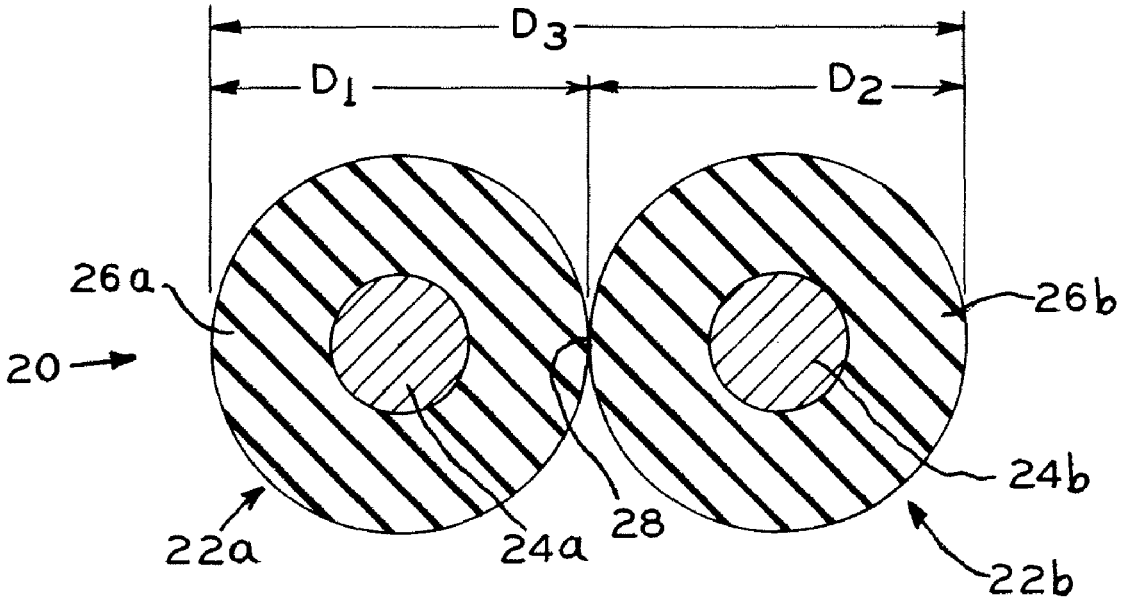
FIG. 1B is a sectional view of two fused single-strand wires according to a process of the present disclosure.

Referring to FIG. 1B, a fused wire 20 that has been produced according to the method of the present disclosure is shown. Fused wire 20 is formed from a pair of individual single strand wires 22*a* and 22*b* that include respective metal conductor wires 24*a* and 24*b*. Wires 24*a* and 24*b* are initially coated by coatings 26*a* and 26*b*, respectively, of an insulation material.

As used herein, the term "wire" or "wire product" encompasses coated and/or uncoated continuous wire, wire products and elongate conductors, whether insulated/coated or uninsulated/uncoated. Examples of "wire" or "wire products" include wire having a round cross section and wire having a non-round cross section, including flat wire or ribbon, as well as other wire-based products such as strands, cables, coil, and tubing.

Figure 1C:
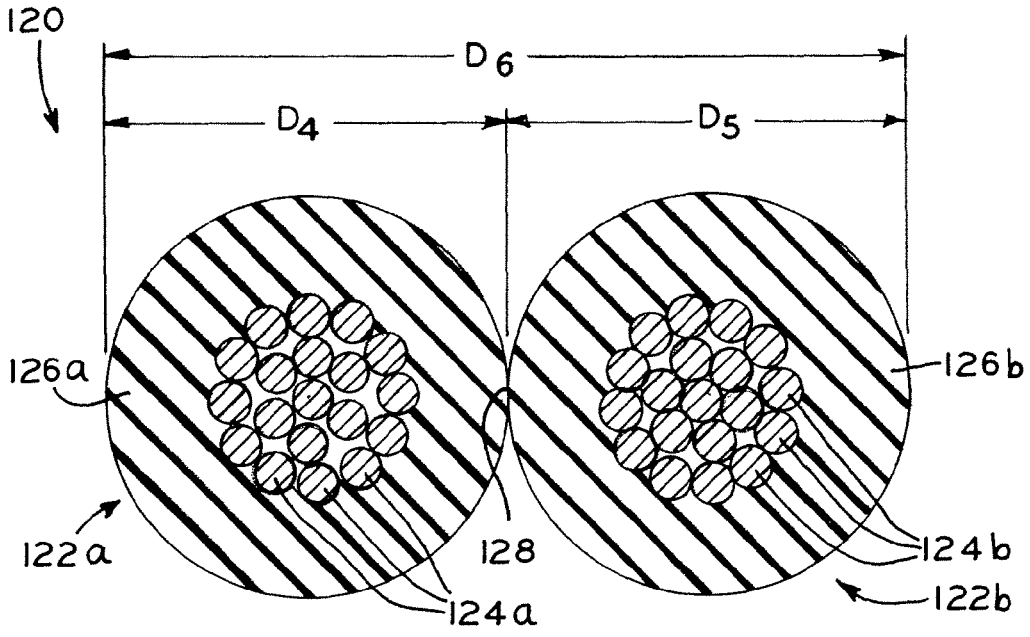
FIG. 1C is a sectional view of two fused multi-strand wires according to a process of the present disclosure.

In another embodiment, illustrated in FIG. 1C, fused wire 120 is formed from a pair of multi-strand wires 120*a* and 120*b*, which are formed by twisting a plurality of individual metal wires 124*a* and 124*b* together. Wires 120*a* and 120*b* are initially coated by insulation coatings 126*a* and 126*b*, respectively.

Figure 1D:
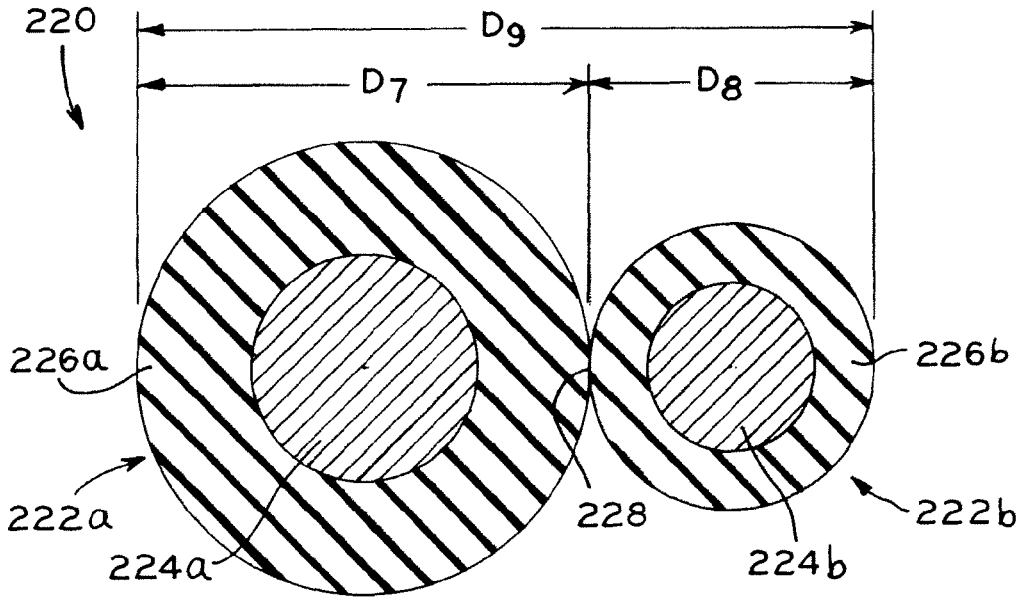
FIG. 1D is a sectional view of a larger wire fused to a smaller wire according to a process in accordance with the present disclosure.

In yet another embodiment, illustrated in FIG. 1D, fused wire 220 is formed from relatively larger wire 222*a* and relatively smaller wire 222*b* that include larger metal conductor wire 224*a* and smaller conductor wire 224*b*, respectively. Wires 224*a* and 224*b* are initially coated by a relatively thick insulation coating 226*a* and a relatively thin insulation coating 226*b*, respectively.

Figure 1E:
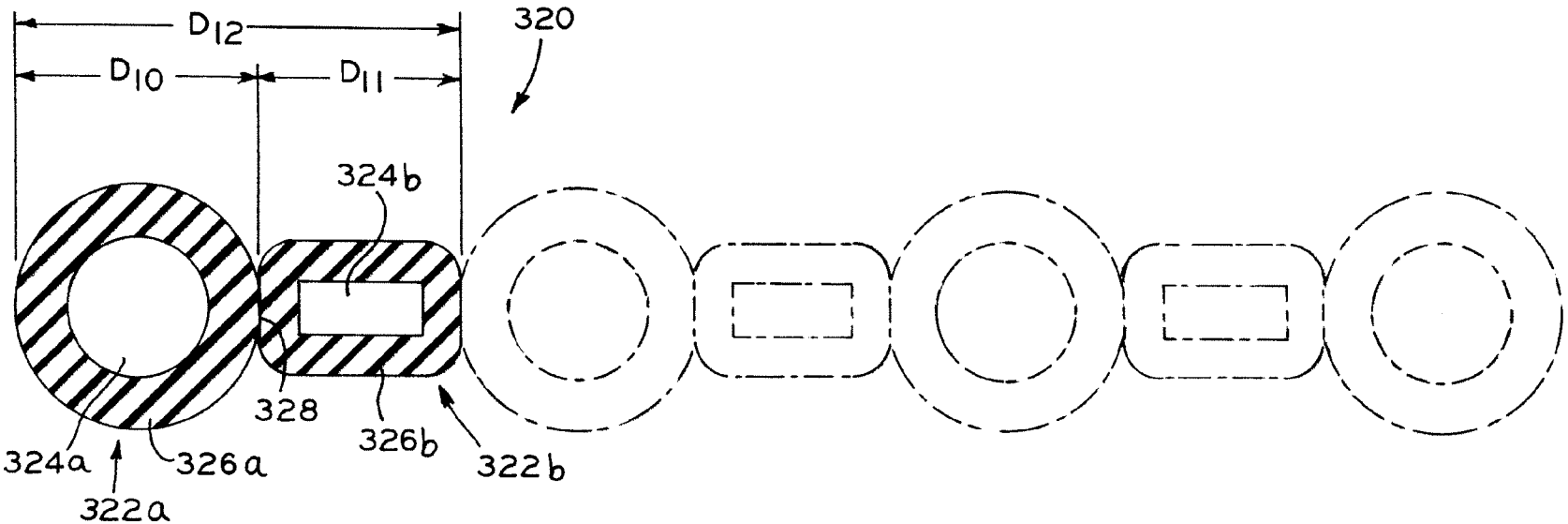
FIG. 1E is a sectional view of round single-strand wire fused to a ribbon according to a process in accordance with the present disclosure.

In still another embodiment, shown in FIG. 1E, fused wire 320 is formed from wire 322*a* and ribbon 322*b*, which include metal conductor wire 324*a* and metal conductor ribbon 324*b*, respectively. Wires 324*a* and 324*b* are initially coated by wire insulation coating 326*a* and ribbon insulation coating 326*b*, respectively. An additional wire 322*a* may be fused to the other side of ribbon 322*b* to form a three-wire "barbell" configuration, or multiples of fused wire 320 may be fused to one another to form a multi-conductor "flat" ribbon cable product.

For purposes of the present disclosure, fused wire 20 will be referred to as an exemplary embodiment. However, the principles of the present disclosure apply equally to wires 120, 220, 320, or any other pairs or multiples of wires, such as three or more wires, with the insulation of the wires joined along a line contact in the manner disclosed herein. Examples of such other pairs or multiples may include shaped wires, groupings of previously fused pairs, any combination of the constituent wires of fused wires 120, 220, 320, and the like. In the manner discussed below in reference to fused wire 20, coatings 26*a*, 126*a*, 226*a*, 326*a* and 26*b*, 126*b*, 226*b*, 326*b* of wires 22*a*, 122*a*, 222*a*, 322*a* and 22*b*, 122*b*, 222*b*, 322*b* are fused together by the present method at respective fusion lines 28, 128, 228, 328 along a line contact between wires 24*a*, 124*a*, 224*a*, 324*a* and 24*b*, 124*b*, 224*b*, 324*b* with minimal, if any, overlap or deformation of coatings 26*a*, 126*a*, 226*a*, 326*a* and 26*b*, 126*b*, 226*b*, 326*b*.

Prior to fusion, wires 22*a* and 22*b* have respective diameters $D_1$ and $D_2$, and fused wire 20 includes a width along a line that connects the centers of conducting wires 24*a* and 24*b*, that will hereinafter be referred to as the overall width, or combined or major diameter $D_3$, of fused wire 20. The major diameter $D_3$ of fused wire 20 substantially or nearly equals the sum of diameters $D_1$ and $D_2$ of the individual wires 22*a* and 22*b* prior to fusion, according to the following formula (I):

$$\text{Fusion }\% = [D_3/(D_1+D_2)]\times 100\% \quad \text{(I)},$$

where Fusion % represents $D_3$ as a percentage of $(D_1+D_2)$, or the extent to which $D_3$ approaches $(D_1+D_2)$. Thus, where Fusion % is a high percentage value, much or substantially all of the original widths $D_1$, $D_2$ of wires 22*a*, 22*b* is retained after the fusion process.

Alternatively, another value, Reduction %, which represents the percentage amount by which $D_3$ is reduced as a percentage of $(D_1+D_2)$, may be represented by the following formula (II):

$$\text{Reduction }\% = 100\% - \text{Fusion }\% \quad \text{(II)}$$

Reduction % can be also be calculated directly from $D_1$, $D_2$ and $D_3$ according to the following formula (III):

$$\text{Reduction }\% = [[(D_1+D_2)-D_3]/(D_1+D_2)]\times 100\% \quad \text{(III)}$$

Thus, where Reduction % is a low percentage value, little or substantially none of the original widths $D_1$, $D_2$ of wires 22*a*, 22*b* is lost after the fusion process.

Representative values for Fusion % and Reduction % are as follows. Fusion % may comprise as little as 75%, 80%, 85%, 87% or 89% or as much as 90%, 93%, 95%, 97%, 99% or nearly 100%, or may be within any range delimited by these values or by the values in the Examples herein. For example, Fusion % may be between 75% and 95%, alternatively, between 90% and 97%, and further alternatively, between 95% and 99%, or greater than 99%. In one exemplary embodiment, Fusion % may be between as little as 95%, 96% or 97% and 98%, 99% and 99.9%, or may be within any range delimited by any of these values. Correspondingly, Reduction % may be 100% less the above Fusion % values, such as between 5% and 25%, alternatively, between 3% and 10%, and further alternatively, between 1% and 5%, or less than 1%. The desired values of Fusion % and Reduction % may vary depending on the diameters of the wires used and coating thicknesses. For instance, a value of 98% for Fusion % might be desirable for a pair of 0.006 inch (0.0152 cm) diameter strands coated to 0.012 inch (0.0305 cm), but not for a pair of 0.011 inch (0.0279 cm) round wires coated to 0.012 inch (0.0305 cm). Moreover, a process of producing fused wire in accordance with the present disclosure may allow a particular desired Fusion % and Reduction % to be obtained, as discussed in detail below.

Similarly to fused wire 20, wires 122*a*, 122*b* of fused wire 120 have respective diameters $D_4$ and $D_5$ which combine to produce major diameter $D_6$ of fused wire 120. Wires 222*a*, 222*b* have respective diameters $D_7$ and $D_g$ which combine to produce major diameter $D_9$ of fused wire 220. Wires 322*a* has diameter $D_{10}$ and ribbon 322*b* has width $D_{11}$ which combine to produce major diameter $D_{12}$ of fused wire 320. Each of fused wires 120, 220, 320 has Fusion % and Reduction % values that are comparable to fused wire 20.

Conductor wires 24*a* and 24*b* may be made of any suitable metal, such as one or more of the following metals: titanium, chromium, niobium, tantalum, vanadium, zirconium, aluminum, cobalt, nickel, and alloys of the foregoing, stainless steels or alloys thereof. Suitable particular alloys include nitinol (nickel/titanium) and alloys conforming to the chemical compositional requirements of ASTM F562 (nominally 35 wt % Co-35 wt % Ni-20 wt % Cr-10 wt % Mo). Suitable ASTM F562 alloys include MP35N® alloys (MP35N® is a registered trademark of SPS Technologies, Inc. of Jenkintown, Pa.), such as 35N LT®, available from Fort Wayne Metals Research Products Corporation of Fort Wayne, Ind. (35N LT® is a registered trademark of Fort Wayne Metals Research Products Corporation of Fort Wayne, Ind.). Also, conductor wires 24*a* and 24*b* may be made of the same or different materials. Conductor wires 24*a* and/or 24*b* may also be constructed in a manner wherein a metal outer shell or tube is filled with another metal, and such construct is then drawn through one or more dies to reduce its diameter, such as DFT® products, available from Fort Wayne Metals Research Products Corporation of Fort Wayne, Ind. (DFT® is a registered trademark of Fort Wayne Metals Research Products Corporation of Fort Wayne, Ind.). Exemplary DFT® products useable with the process of the present disclosure are disclosed in U.S. Pat. Nos. 7,420,124 and 7,501,579, filed Sep. 13, 2004 and Aug. 15, 2005 respectively, each entitled DRAWN STRAND FILLED TUBING WIRE and commonly assigned with the present application, the disclosures of which are hereby incorporated by reference herein in their entireties. However, the material of the conductors is not thought to have a significant impact on the present fusion process.

Coatings 26*a* and 26*b* may be made of a polymeric material, such as a thermoplastic elastomer or a melt-processable fluoropolymer. Suitable fluoropolymers include polytetrafluoroethylene (PTFE), methyl fluoro alkoxy (MFA), fluoro ethylene propylene (FEP), perfluoro alkoxy (PFA), poly (chlorotrifluoroethylene), poly(vinylfluoride), co-polymers of tetrafluoroethlyene and ethylene (ETFE), polyvinylidene fluoride (PVDF), and co-polymers of tetrafluoroethylene, hexafluoropropylene, and vinylidene difluoride (THV).

Coatings 26*a* and/or 26*b* may also be formed by engineering resins or polymers. Suitable engineering polymers include PolyEther Ether Ketone (PEEK), PolyEther Sulphone (PES), PolyPhenylene Sulfide (PPS), PolyAmide Imide (PAI), Epoxy polymers, Polyester, Polyurethane (PU), Acrylic and PolyCarbonate (PC), for example.

Optionally, the coatings 26*a* and 26*b* may be pigmented with different colors to aid in differentiating the two wires 24*a* and 24*b*. Further, although coatings 26*a* and 26*b* are typically formed of the same material, it is within the scope of the present disclosure that coatings 26*a* and 26*b* (or any additional coatings) may each be formed of different materials, as discussed below.

The following are representative diameters and thicknesses of the conductor wires 24*a* and 24*b* and coatings 26*a* and 26*b* of wires 22*a* and 22*b* (FIG. 1B) that may be fused according to the present process. For wires 22*a* and 22*b* in which conductor wires 24*a* and 24*b* formed of round wires, same may have diameters $D_1$, $D_2$ ranging from about 0.002 inch (0.0051 cm) to 0.015 inch (0.0381 cm), with the thickness of coatings 26*a* and 26*b* ranging from 0.00075 inch (0.0019 cm) to 0.010 inch (0.0254 cm). In one exemplary embodiment discussed in Example 1 below, wires 22*a* and 22*b* may have individual diameters $D_1$, $D_2$ prior to fusion of about 0.01205 inch (0.0306 cm) including conductor wires 24*a* and 24*b* and coatings 26*a* and 26*b*), and a fused combined diameter of between about 0.02312 inch (0.0587 cm) and 0.02381 inch (0.0605 cm). Thus, following Formula (I) above, Fusion % for this exemplary embodiment is between about 95.95% and about 98.75%.

In an exemplary embodiment of fused wire 120 (FIG. 1C), multi-strand wires 120*a* and 120*b* may have an overall diameter ranging from about 0.002 inch (0.0051 cm) to 0.015 inch (0.0381 cm). In the illustrated embodiment of FIG. 1C, the overall diameters $D_4$, $D_5$ of the multi-strand wires is 0.01205 inch (0.0306 cm), with the plurality of individual metal wires 124*a* and 124*b* having individual diameters of 0.0012 inch (0.0030 cm). The thickness of insulation coatings 126*a* and 126*b* may range from about 0.00075 inch (0.0019 cm) to 0.010 inch (0.0254 cm). In the illustrated embodiment of FIG. 1C, the thickness of coatings 126*a* and 126*b* is 0.003 inch (0.0076 cm). After wires 120*a*, 120*b* are fused together into fused wire 120, combined diameter $D_6$ is about 0.0236 inch (0.0599 cm). Thus, following Formula (I) above, Fusion % for this exemplary embodiment is about 97.93%.

In an exemplary embodiment of fused wire 220 (FIG. 1D), relatively larger wire 222*a* may have an overall diameter $D_7$ of about 0.0082 inch (0.0208 cm), while relatively smaller wire 222*b* may have an overall diameter $D_g$ of about 0.005 inch (0.0127 cm). The thicknesses of the relatively thick insulation coating 226*a* and the relatively thin insulation coating 226*b* may be about 0.0021 inch (0.0053 cm) and 0.001 inch (0.0025 cm), respectively. After wires 220*a*, 220*b* are fused together into fused wire 220, combined diameter $D_9$ is about 0.0129 inch (0.0328 cm). Thus, following Formula (I) above, Fusion % for this exemplary embodiment is about 97.73%.

In an exemplary embodiment of fused wire 320 (FIG. 1E), wire 322*a* may have an overall diameter $D_{10}$ of about 0.0082 inch (0.0208 cm), while ribbon 322*b* has overall dimensions of about 0.015 inch (0.0381 cm) width (i.e., $D_{11}$) and about 0.008 inch (0.0203 cm) height. The thickness of wire insulation coating 326*a* may be about 0.00211 inch (0.0054 cm), while ribbon insulation coating 326*b* may have a thickness of about 0.0015 inch (0.0038 cm). Fused wire 320 has a "lollipop" cross sectional profile, with wire 322*a* positioned atop ribbon 322*b*. This "lollipop" profile may form the building block for a ribbon cable product, in which several fused wires 320 are placed end-to-end to create an alternating round/flat/round profile to create a "flat" multi-conductor cable. A three-conductor cable with a "dumbell" cross-sectional profile may also be created by fusing two of wires 322*a* to each of the two shorter faces of ribbon 322*b*. After wires 320*a*, 320*b* are fused together into fused wire 320, combined diameter $D_{12}$ is about 0.0225 inch (0.0572 cm). Thus, following Formula (I) above, Fusion % for this exemplary embodiment is about 96.98%.

The dimensions given above with respect to FIGS. 1B-1E are exemplary, and these dimensions may vary substantially in other wires and wire products produced in accordance with the present disclosure.

2. Method of Manufacturing Fused Wires in Accordance with the Present Disclosure Referring to FIG. 2, an apparatus 30 for carrying out the present method is shown. Wire fusion apparatus 30 generally includes a frame 32, which may be any structure capable of supporting the various components of the apparatus 30 as described below. In one embodiment, frame 32 includes a vertical rail member 34 with one or more channels into which a plurality of trolleys 35 are received. The trolleys 35 are adjustably fixable to, and selectively locatable along, the rails 34 for supporting the various components of the apparatus 30 as described below. However, the apparatus 30 may be configured in any manner suitable in accordance with the present method, which is discussed in detail below.

A pair of payout assemblies 40 support spools 42 of insulated wires 22*a* and 22*b*, and generally include shafts 44 to which spools 42 are mounted. As described below, a capstan apparatus 110 pulls wires 22*a* and 22*b*, and the resulting fused wire 20, through the apparatus 30 and provides tension to these wires as same move through apparatus 30. Payout assemblies 40 may include back-tensioning elements for providing a back tension or resistance to the wires 22*a* and 22*b* throughout their travel though apparatus 30. In one embodiment, the back-tensioning elements are magnetic clutches 46 which operate to apply a braking force to shafts 44 on which spools 42 are mounted. Magnetic clutches 46 may be adjustable independently of one another to provide differing amounts of braking force to shafts 44 to thereby vary the back tension or resistance as needed, such as when the mass or diameter of one spool 42 differs from the other and/or to otherwise allow independent control over the payout of wires 22*a* and 22*b* from spools 42.

The independent payout wire tensions provided by the pair of back-tensioning elements are also useful when the construction or sizing of wires 22*a* and 22*b* varies. For example, if a first wire having a large round conductor, such as wire 224*a* (FIG. 1D) is to be fused to a second wire having a conductor formed of a similarly-sized strand, the first and second wires will each require an upward adjustment tension as compared to wires 22*a* and 22*b*. Also, if a first wire having a large round conductor is to be fused to a second wire having a small round conductor, such as wires 224*a* and 224*b* in fused wire 220 (FIG. 1D), the first wire will require an upward adjustment of tension while tension in the second wire may remain lower.

Spools 42 each hold respective lengths of wires 22*a*, 22*b*, which wires have been previously coated with their respective coatings 26*a*, 26*b* of insulation of the type described above by any extrusion-type process, for example, and wherein the insulation of coatings 26*a*, 26*b* has substantially or fully cured prior to the wire fusion process discussed below. By substantially or fully cured, it is meant that the insulation material of coatings 26*a*, 26*b* has set, cooled, and cured to the point where the material is no longer tacky, and wires 22*a* and 22*b* are therefore able to be rolled onto spools 42, and thence unrolled from spools 42, while maintaining the shape and dimensional integrity of the insulation material.

Figures 2, 5, 9, 10:
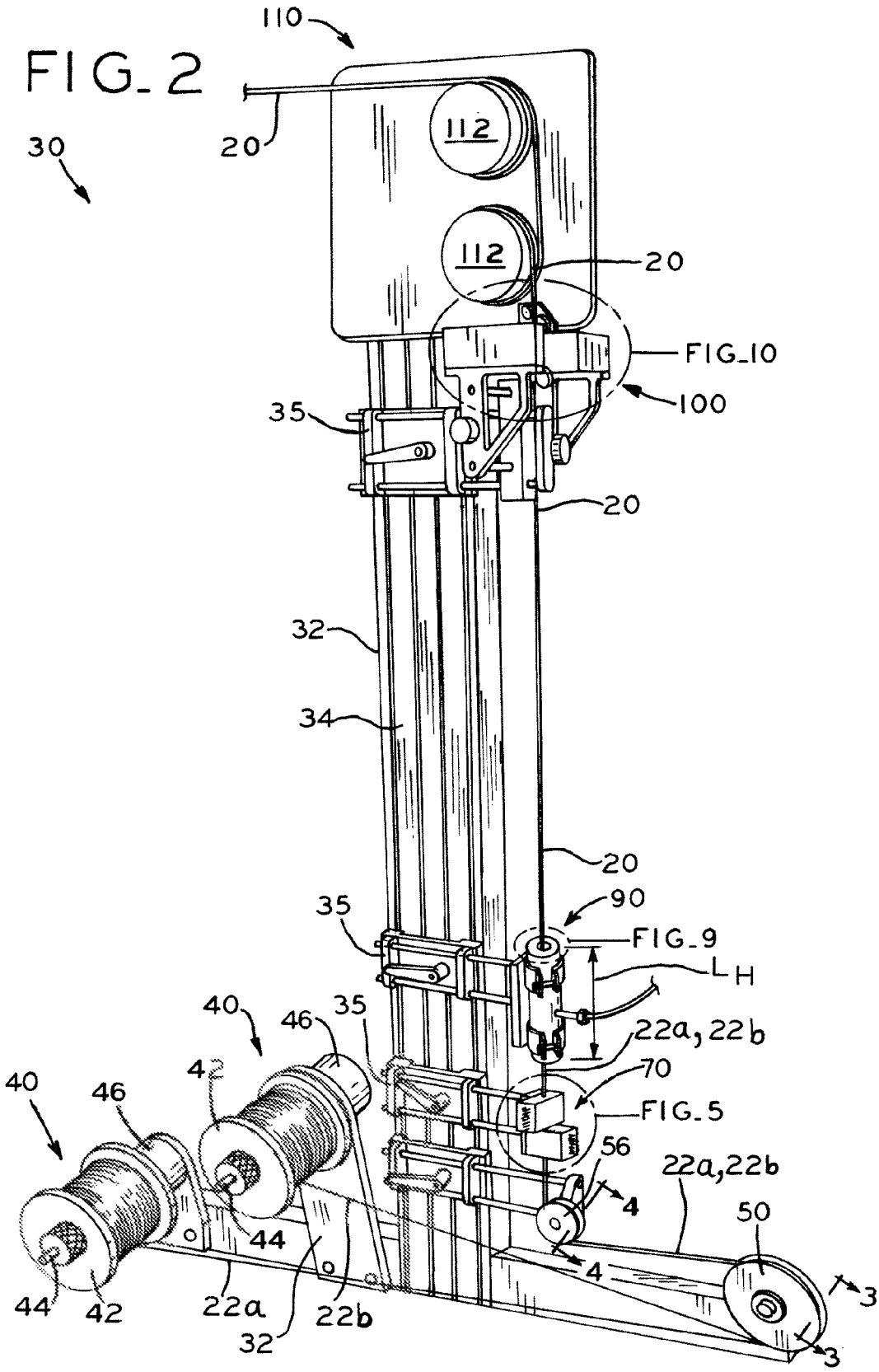
FIG. 2 is a perspective view of an exemplary apparatus for manufacturing the fused wires of FIGS. 1B-1E.
FIG. 5 is a fragmentary view of the apparatus of FIG. 2, showing the wire straightening device.
FIG. 9 is a fragmentary view of a portion of the apparatus of FIG. 2, showing a portion of the heating device.
FIG. 10 is a fragmentary view of a portion of the apparatus of FIG. 2, showing the measurement device.
Figure 3:
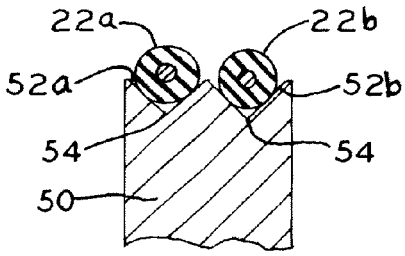
FIG. 3 is a sectional view taken along line 3-3 of FIG. 2.
Figure 4:
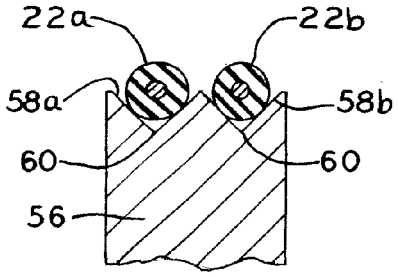
FIG. 4 is a sectional view taken along line 4-4 of FIG. 2.
Figure 5:
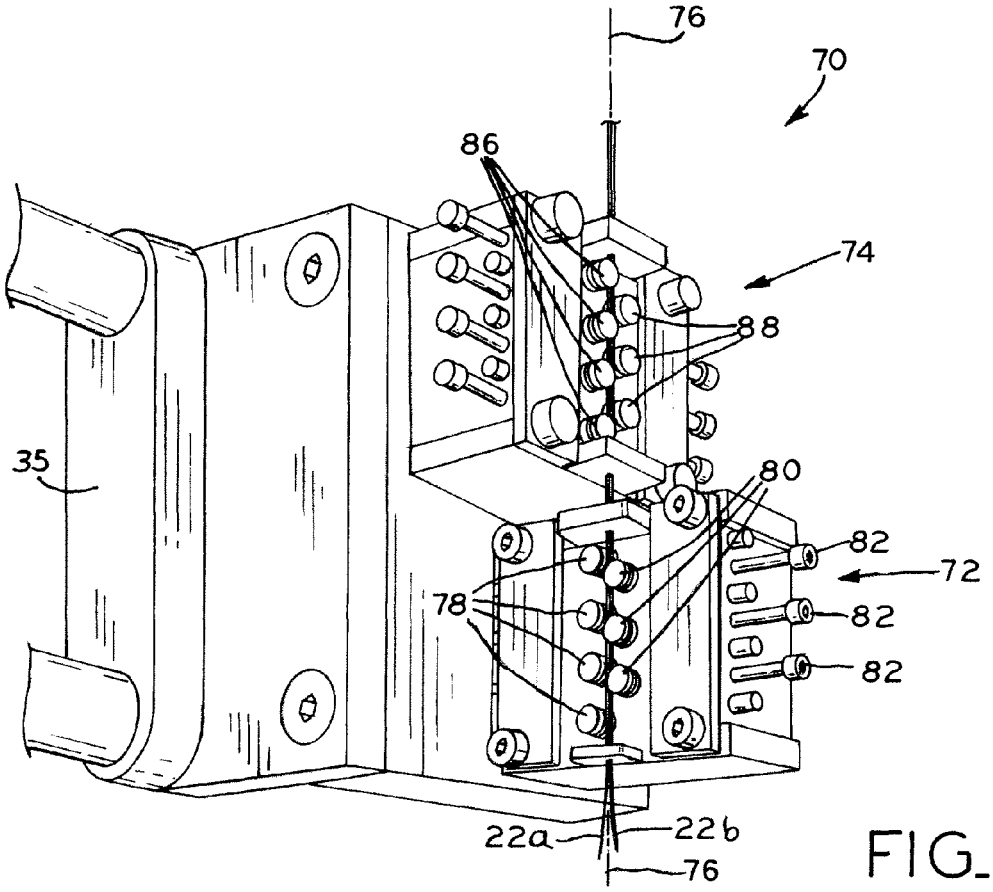

After wires 22*a* and 22*b* are paid out from spools 42, same are wrapped around a first pulley 50 which, as shown in FIG. 3, includes a pair of grooves 52*a* and 52*b* respectively receiving wires 22*a* and 22*b* and maintaining wires 22*a* and 22*b* spaced slightly apart from one another. In one embodiment, grooves 52*a* and 52*b* are V-shaped, and the apexes 54 of the grooves are spaced apart from one another. Grooves 52*a* and 52*b* are shown with substantially equal sizes and geometries, as appropriate for wires 22*a* and 22*b*. For wires of differing size and/or geometry, such as wires 222*a*, 222*b* of fused wire 220 or wire 322*a* and ribbon 322*b* of fused wire 320, the size and/or geometry of grooves 52*a* and 52*b* is adjusted accordingly. As shown in FIG. 2, wires 22*a* and 22*b* are turned around pulley 50 such that the direction of wires 22*a* and 22*b* is reversed, i.e., wires 22*a* and 22*b* make 180° and 190° turns, respectively. In other embodiments, wires 22*a* and 22*b* may make a lesser or greater turn around pulley 50, such as between 90° and 270°, and in one embodiment, wires 22*a* and 22*b* are turned around pulley 50 about 150°.

Wires 22*a* and 22*b* are then wrapped around a second pulley 56 which, as shown in FIG. 5, includes a pair of grooves 58*a* and 58*b* respectively receiving wires 22*a* and

22*b* and maintaining wires 22*a* and 22*b* spaced slightly apart from one another. In one embodiment, grooves 58*a* and 58*b* are V-shaped, and the apexes 60 of the grooves are spaced apart from one another. Similar to grooves 52*a* and 52*b*, grooves 58*a* and 58*b* are shown with substantially equal sizes and geometries. For wires of differing size and/or geometry, the size and/or geometry of grooves 58*a* and 58*b* may also be adjusted accordingly. As shown in FIG. 2, wires 22*a* and 22*b* are turned around pulley 56 such that the direction of wires 22*a* and 22*b* is moved from horizontal to vertical, i.e., wires 22*a* and 22*b* make a 90° turn. In other embodiments, wires 22*a* and 22*b* may make a greater or lesser turn around pulley 56, such as any turn less than 180° and, in one particular embodiment, wires 22*a* and 22*b* are turned around pulley 56 about 135°.

First and second pulleys 50 and 56 tension the wires 22*a* and 22*b* apart from one another, allowing the wire straightening device 70, shown in FIG. 5 and described below, to bring the wires 22*a* and 22*b* in abutting contact with one another along a line contact in the manner described below. First and second pulleys 50 and 56 also direct wires 22*a* and 22*b* in parallel relation to one another along the vertical progression direction of the apparatus 30, and second pulley 56 reinforces the spacing between the wires 22*a* and 22*b* which is initially provided by pulley 50, which provides lateral tension to the wires 22*a* and 22*b* to facilitate bringing the wires 22*a* and 22*b* into positive but light contact with one another in wire straightening device 70, described below.

Figure 6:
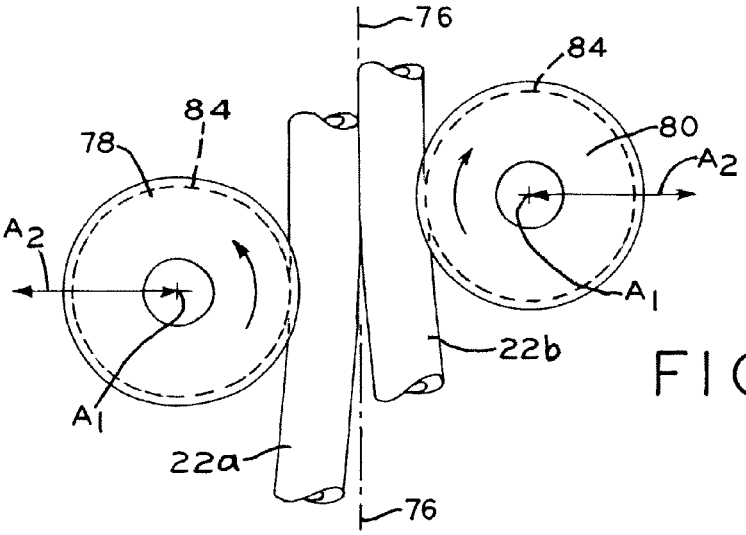
FIG. 6 is a first schematic view of a pair of rollers of the first wire straightening assembly of the wire straightening device of FIG. 5.
Figure 7:
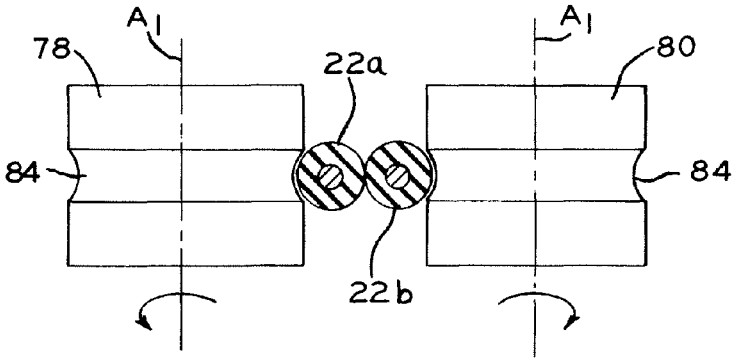
FIG. 7 is a second schematic view of a pair of rollers of the first wire straightening assembly of the wire straightening device of FIG. 5.

Referring generally to FIGS. 5-8, wires 22*a* and 22*b* enter a wire straightening device 70 after traveling around pulleys 50, 56. As shown in FIG. 5, wire straightening device 70 generally includes a first straightening assembly 72, and a second straightening assembly 74 which is oriented at 90° with respect to first straightening assembly 72. First and second straightening assemblies 72 and 74 are together oriented along a nominal axis 76 of the device 70 which corresponds to, i.e., is coaxial with, the vertical progression direction or wire path of wires 22*a* and 22*b* through the apparatus 30 following the exit of wires 22*a* and 22*b* from second pulley 56. First straightening assembly 72 includes a row of first rollers 78 and a row of second rollers 80, each disposed parallel to nominal axis 76. Each roller 78 and 80 is independently laterally adjustable with respect to axis 76 by its associated thumb screw 82 or other manual adjustment device, so that roller 78 and/or roller 80 can be advanced toward or away from the wire path illustrated as nominal axis 76. As shown in FIGS. 6 and 7, each roller 78 and 80 includes a small groove 84 (FIGS. 6 and 7) for receipt of a respective wire 22*a* or 22*b*, and rollers 78 and 80 are rotatable on respective central axes $A_1$ which are perpendicular to nominal axis 76.

In first straightening assembly 72, wire 22*a* is received within grooves 84 of first rollers 78 in the first row, and wire 22*b* is received within grooves 84 of rollers 80 in the second row. Thumb screws 82, shown in FIG. 5, are used to laterally adjust rollers 78, 80 independently toward and away from nominal axis 76 of the device 70, i.e., along the directions of arrows $A_2$ in FIG. 6 to advance roller 78 and/or roller 80 toward or away from the wire path illustrated as nominal axis 76. Rollers 78, 80 are adjusted in order to bring wires 22*a* and 22*b* in light abutting contact with one another such that their respective coatings 26*a* and 26*b* just barely touch one another along a line contact corresponding to nominal axis 76. Due to the size of device 70 in the illustrated embodiment, a magnifying glass or other magnification device may be used by an operator to manually adjust each of thumb screws 82 to thereby set the distance between the rollers 78 and 80 of the first and second rows such that wires 22*a* and 22*b* having coatings 26*a* and 26*b* of a given thickness are brought into light abutting contact with one another along a line contact. In this manner, first straightening assembly 74 may be adjusted for wires 22*a* and 22*b* of any given thickness.

Figure 8:
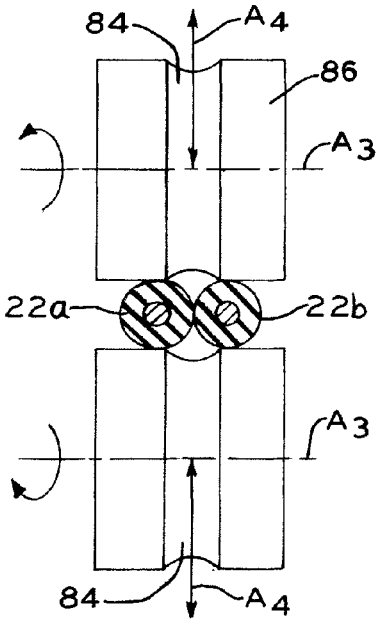
FIG. 8 is a schematic view of a pair of rollers of the second wire straightening assembly of the wire straightening device of FIG. 5.
Figure 9:
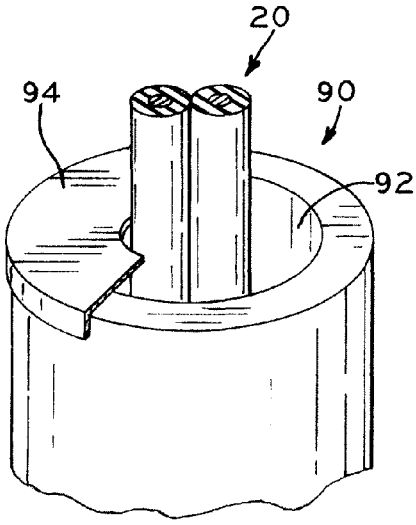
Figure 10:
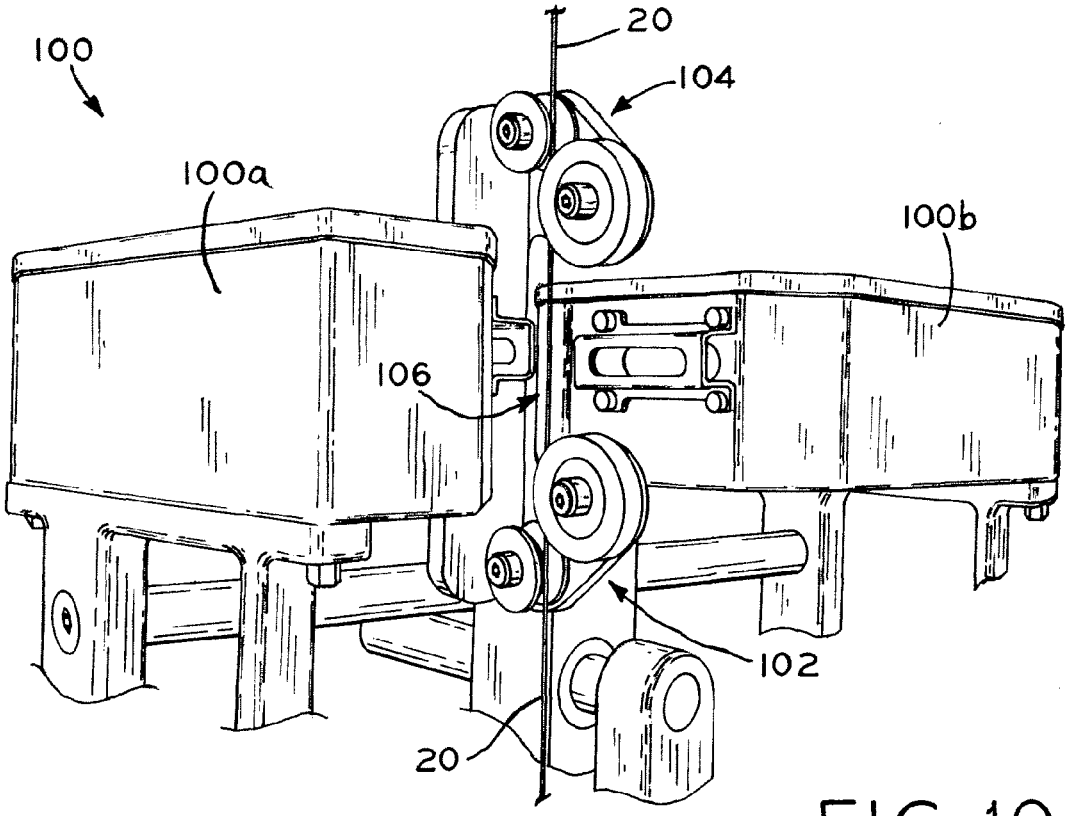

Second straightening assembly 74 (FIG. 5) includes a row first rollers 86 and a second row of rollers 88, each disposed parallel to nominal axis 76. However, as shown in FIGS. 5 and 8, rollers 86 and 88 are oriented 90° with respect to the rollers 78 and 80 of first straightening assembly 74, and contact both of wires 22*a* and 22*b* on respective opposite sides of wires 22*a* and 22*b* to maintain wires 22*a* and 22*b* in the same plane, which is parallel to nominal axis 76. Rollers 86 and 88 are rotatable on respective central axes $A_3$ (FIG. 8) which are perpendicular to nominal axis 76, and thumb screws 82 are used to laterally adjust rollers 86 and 88 independently toward and away from axis nominal 76 of the device 70, i.e., along the directions of arrows $A_4$ in FIG. 8.

The light abutting contact of wires 22*a* and 22*b* provided by the rollers 78, 80, 86, and 88 of wire straightening device 70 is important for overcoming the following potential disadvantages that are present in known processes. First, heavier contact can mar the surfaces of the coatings of wires 22*a* and 22*b*. In particular, small coating thicknesses may mar, leading to scuffs, flat spots, etc., with very little force. Second, the peaks and valleys of strands and cables that may be used for the conductors of wires 22*a* and 22*b* can be relatively extreme. If the strand or cable peaks of the parallel wires 22*a* and 22*b* are aligned, the passage of wires 22*a* and 22*b* through a bottleneck created by the rollers 78, 80, 86, and 88 of wire straightening device 70 could potentially reduce the thickness of the insulation coating at that point. Third, heavy contact applied to strands and cables could potentially deform the coated strands from round to oval in shape. Finally, heavy contact may tend to cause the pair of wires 22*a* and 22*b* to twist out of the desired plane of alignment provided by the rollers 78, 80, 86, and 88 of wire straightening device 70. Moreover, the light abutting contact of wires 22*a* and 22*b* provided by rollers 78, 80, 86, and 88 facilitates a thermal joining or fusion of wires 22*a* and 22*b* along a line contact to form fused wire 20, as discussed below. Although several rollers 78, 80, 86, 88 are shown in the illustrated embodiment, fewer rollers may be used.

For fused wires 120, 220, 320 or other fused wire products, the geometry of grooves 84 and/or spacing of rollers 78, 80 and 86, 88 may be adjusted. For example, groove 84 on one of rollers 78, 80 may be made larger to accommodate larger wire 222*a* (FIG. 1D). Alternatively, groove 84 on one of rollers 78, 80 may have a rectangular shape to accommodate ribbon 322*b* (FIG. 1E). The spacing between rollers 86, 88 may be enlarged to accommodate the larger of a differently sized pair of wires, or rollers 86, 88 may be eliminated altogether.

After exiting wire straightening device 70, wires 22*a* and 22*b* are maintained in light abutting contact with one another such that their respective coatings 26*a* and 26*b* are just barely touching one another along a line contact. Wires 22*a* and 22*b* then enter heating device 90 positioned downstream, or above, wire straightening device 70. Heating device 90 may be a convection-type heater, for example, which includes two thick-walled aluminum tubes heated by three heater bands, with two heater bands on one tube, and one on the other. Referring additionally to FIG. 9, the tubes define an interior heating chamber 92, and are placed within a few inches of the exit of the wire straightener 70. The temperature in chamber 92 is held at a selected target by digital heater controllers, and a suitable gasket 94, having an opening for fused wire 20 to pass therethrough, may be placed on the upper end of heating device to minimize heat loss from chamber 92.

Heating device 90 is used to apply thermal energy to wires 22*a*, 22*b* as they pass through heating chamber 92. In order to apply a desired amount of thermal energy over a particular time interval, several variables may be manipulated within apparatus 30. These variables include temperature in heating chamber 92, the length $L_H$ of heating device 90, and the line speed of wires 22*a*, 22*b*.

Heating device 90 has length $L_H$, which may be lengthened or shortened to change the time of exposure of wires 22*a*, 22*b* to heating chamber 92. Such lengthening may be accomplished by using different lengths of heating device 90, or by stacking multiple short heating devices 90, one atop the other.

Another variable affecting the overall amount of thermal energy imparted to wires 22*a*, 22*b* in heating chamber 92 is the line speed of wires 22*a*, 22*b*. The speed of progression of wires 24*a* and 24*b* through heating device 90, i.e., the elapsed time between when a given point on wires 24*a* and 24*b* is exposed to the elevated temperature in heating device 90 and when such point exits heating device 90, referred to herein as "time at temperature," may be varied to affect the extent of fusion of the wires. For a given length $L_H$ and configuration of heating device 90, and a given temperature of heating chamber 92, the speed at which wires 22*a*, 22*b* pass through chamber 92 determines the time at temperature by the following equation (IV)

$$T_T = L_H / WS, \quad \text{(IV)}$$

where $T_T$ is the time at temperature, $L_H$ is the length of heating device 90, and WS is the linear speed of the wire as it passes through the heating device.

To achieve a desired temperature of coatings 26*a*, 26*b*, such as a thermal transition temperature as discussed below, length $L_H$, time at temperature, and/or the temperature within chamber 92 may be increased. Alternatively, the desired temperature may be achieved even where one or more variables are decreased, provided that another variable is increased sufficiently. For example, at a given temperature in chamber 92, line speed may be increased where length $L_H$ is also increased. Alternatively, the temperature in chamber 92 may be increased to compensate for a shorter length $L_H$ and/or a faster line speed. Advantageously, this control over the variables affecting fusion of wires 22*a*, 22*b* facilitates prediction of, and control over, the value obtained for Fusion % and Reduction % in the finished product.

Figure 13:
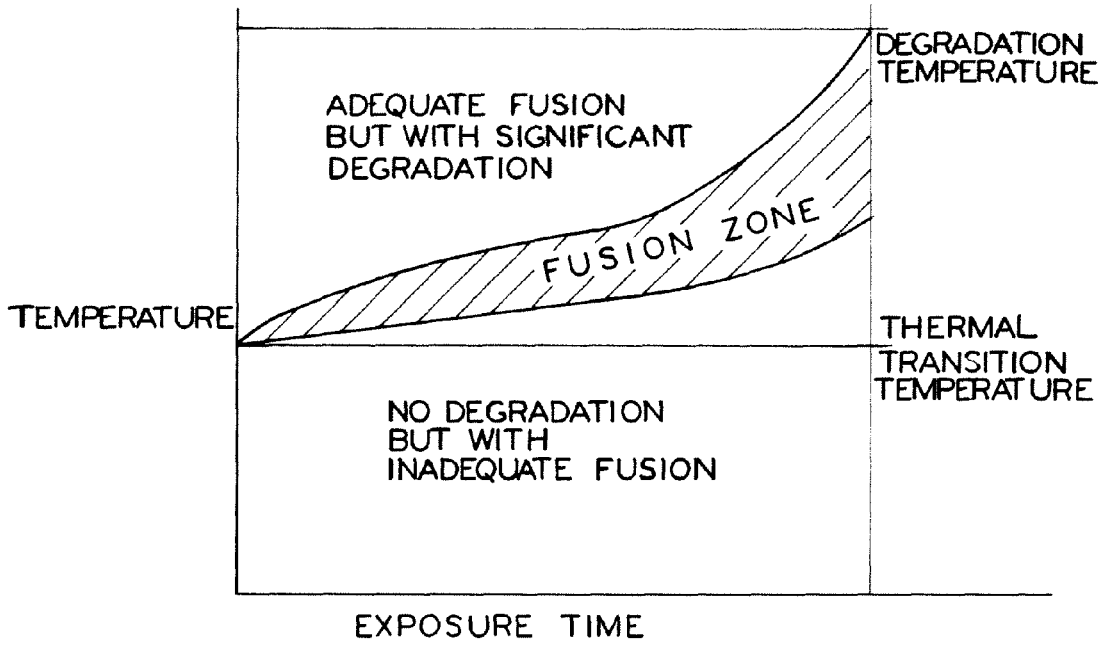
FIG. 13 is a plot of thermal energy applied to a wire vs. the temperature of a heating device through which the wire passes, illustrating a desirable range of thermal energy and temperature values.
Figure 14:
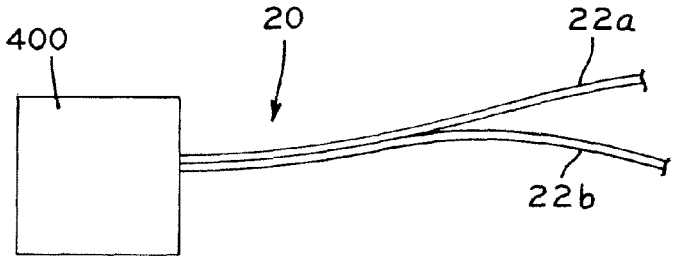
FIG. 14 is a schematic view of a medical device with a wire in accordance with the present disclosure attached thereto.

For some materials, the temperature of chamber 92 should be kept low enough to prevent scorching of coatings 26*a*, 26*b*, where coatings 26*a*, 26*b* burn or degrade rather than fuse. Referring to FIG. 13, the relationship of heating chamber temperature vs. exposure time of wires 22*a*, 22*b* to that temperature is shown. At relatively low temperatures, i.e., temperatures at or near the thermal transition temperature of a given coating material, longer exposure times will be required to reach the "fusion zone" where proper fusion occurs in accordance with the present disclosure. If temperature is too low and/or exposure is too short, no degradation of coatings 26*a*, 26*b* will occur, but fusion will also not occur or will be insufficient to adequately bond wires 22*a*, 22*b*. Exposure time can be shortened by increasing temperature, but if temperature is raised too high for a given exposure time, degradation or "scorching" of coatings 26*a*, 26*b* Occurs.

In heating device 90, the insulation material of coatings 26*a* and 26*b* of wires 22*a* and 22*b* is heated to just above the softening or thermal transition point of the material, such that, along the line contact between coatings 26*a* and 26*b*, coatings 26*a* and 26*b* fuse with one another to form fused wire 20. Where coating 26*a* has a different thermal transition temperature as compared to coating 26*b*, such as where coatings 26*a* and 26*b* are made of a different materials, wires 22*a*, 22*b* may be heated to a temperature corresponding with the lower of the different thermal transition temperatures. When so heated, one of coatings 26*a*, 26*b* bonds to the other of coatings 26*a*, 26*b* along the line contact between coatings 26*a* and 26*b* to fuse the thermally transitioned coating to the non-thermally transitioned coating.

As used herein, a "thermal transition" point or temperature refers to the conditions at which a material undergoes a change in material properties consistent with a change in temperature. For example, a thermal transition point for a crystalline polymer may be the temperature at which the solid begins to melt at a given pressure. On the other hand, the thermal transition point for an amorphous or partially crystalline polymer may be the glass transition temperature at a given pressure.

Examples of thermal transition temperatures for some exemplary polymers (as discussed above) at atmospheric pressure are as follows: ETFE has a melt temperature of about 500 deg. Fahrenheit/260 deg. Celsius; PEEK has a glass transition temperature of about ~143° C. and a melt point about ~343° C.; PES has a glass transition temperature of about ~193° C. and a melt point of about 255° C., depending on grade; PPS has a glass transition temperature of about 85° C. and melting point of about ~285° C.; PAI has a glass transition temperature of about 280° C.; and polyesters have glass transitions in the region of (but not limited to) 70° C. and melt points ~265° C. PU glass transitions and melt points depending on polymer matrix and application, while epoxy glass transition temperature and melt point vary dependent upon the polymer backbone.

In an exemplary embodiment, coatings 26*a* and 26*b* are made of ETFE with a thermal transition temperature of about 500 deg. Fahrenheit, and are fused into fused wire 20 using a length $L_H$ of heating device 90 of 7.5 inches (19.1 cm), a line speed ranging from between 2.4 and 12.2 ft/min (73.2 and 371.9 cm/min), and a temperature in chamber 92 ranging from 490 to 720 degrees fahrenheit (254.4 to 382.2 degrees Celsius).

With subsequent cooling downstream of heating device 90 with wires 22*a* and 22*b* maintained in light abutting contact with one another along the line contact at which the coatings 26*a* and 26*b* are fused, the insulation material of the coatings 26*a* and 26*b* will fully cure to connect the wires 22*a* and 22*b* along the line contact. Due to the vertical orientation of apparatus 30 and the vertical progression direction of wires 22*a* and 22*b* through apparatus 30, potential gravity-based deformation of the coatings 26*a* and 26*b* within, and downstream of, heating device 90 is prevented.

Advantageously, because wires 22*a* and 22*b* are brought into, and maintained in light abutting contact with one another along the fusion line 28, wires 22*a* and 22*b* are not physically pressed against one another which, upon heating and softening of coatings 26*a* and 26*b*, would cause coatings 26*a* and 26*b* to be pressed into and merged with one another as discussed above with reference to FIG. 1A, and/or otherwise causing deformation of the insulation material and the shape of the coatings 26*a* and 26*b*. The lack of deformation or marring of wires 22*a* and 22*b*, together with the line contact fusion described herein, produces a fused wire 20 in which the dimensional characteristics of individual wires 22*a*, 22*b* is substantially maintained. These dimensional characteristics may include: concentricity of wires 24*a*, 24*b* with coatings 26*a*, 26*b* respectively; integrity of coatings 26*a*, 26*b*, particularly along the fusion line 28; and the uniformity of the thickness of coatings 26*a*, 26*b*. Thus, fused wire 20 exhibits little or no degradation in ratings for voltage and/or amperage, so that the individual power transmission capabilities of wires 22*a*, 22*b* are substantially retained even after the fusion process. This power-transmission retention is particularly beneficial for certain applications, such as cardiac rhythm management, where fused wire 20 may be required to withstand repetitive and/or continuous transmissions of relatively large amounts power.

Also advantageously, wires 22*a* and 22*b* may be separated from one another without significantly compromising the integrity, uniformity or dimensional characteristics of coatings 26*a*, 26*b*. The force required to break the chemical bonds formed along fusion line 28 is substantially lower as compared to a traditional fused wire, such that applying the force will not result in wires 22*a*, 22*b* experiencing stress sufficient to damage or deform the material of coatings 26*a* or 26*b*. Thus, wires 22*a*, 22*b* also exhibit little or no degradation in ratings for voltage and/or amperage, so that the individual power transmission capabilities of wires 22*a*, 22*b* are substantially retained even after wires 22*a*, 22*b* have been separated from fused wire 20.

After the fusion process is complete, the fused wire 20 is passed through a measurement device, shown in FIG. 10. In one embodiment, the measurement device may include a laser micrometer 100, and associated pairs of first pulleys 102 and 104 for maintaining the vertical orientation of fused wire 20. Laser micrometer 100 generally includes a pair of modules 100*a* and 100*b* defining a gap space 106 through which fused wire 20 passes. One or more lasers are directed between modules 100*a* and 100*b*, are oriented perpendicular to the progression direction of fused wire 20, and are used to measure the combined diameter $D_3$ of fused wire 20.

After exiting laser micrometer 100, fused wire 20 is directed around a pair of wheels 112 of a capstan device 110, and is thereafter fed onto a spool on a take-up device (not shown) which includes an accumulator, a spark test chamber, and a foot-counting device. At least one of the wheels 112 of the capstan device is driven or powered and functions to pull the wires 22*a* and 22*b*, and the resulting fused wire 20, and thereby apply tension throughout the apparatus 30. Fused wire 20 may be wrapped multiple times around each of wheels 112 to impart adequate frictional force to prevent slippage of wire 20 with respect to wheels 112. Alternatively a device having multiples wheels 112 may be used, where wheels 112 may be staggered. One or more of the wheels 112 may be driven, with wires fused wire 20 having a substantial wrap angle around each of wheels 112, such as at least 180 degrees. The wrap angle and number of wheels cooperate to produce a large area of contact between fused wire 20 and wheels 112, thereby minimizing or eliminating slippage of fused wire 20 with respect to the surface of wheels 112.

3. Apparatuses Using Fused Wires in Accordance with the Present Disclosure

Wires made in accordance with the present disclosure may be useable with a variety of medical device applications where multiple wires are fused along at least a portion of the wires' lengths.

For example, biostimulation devices such as cardiac pacing devices, neurostimulation devices, and the like may have a power source coupled to an anatomical structure, such as the heart or neural pathways, via electrically conducting wire. The wire transmits power from the power source to the anatomical structure via positive and negative leads, each of which may be attached to a different part of the anatomical structure.

In some cases, the wire must be passed through small spaces within the body of the patient in order to route the wire from the power source to the power delivery site. To facilitate this routing, multiple wires are joined into a single fused wire, such as fused wire 20 discussed above, which may be passed through the body as a unitary whole. When the individual components of the wire, such as wires 22*a*, 22*b* of wire 20 reach the anatomical structure, the fused wire must be split to allow each wire to be routed to different portions of the anatomic structure.

Advantageously, fused wire 20 is well suited to such an application because fused wire 20 may be easily and uniformly split into wires 22*a*, 22*b* without significantly compromising coatings 26*a*, 26*b* of wires 22*a*, 22*b*, as discussed above. Alternatively, wires 22*a*, 22*b* may be coupled with a processor or computer for transmitting sensor signals, rather than for power transmission. Further, multiples of fused wire 20, or a multiple-conductor wire as discussed above, may be used for both power and signal transmission.

In an exemplary embodiment, medical device 400 may be implanted into the body of a patient, or may be carried on the person of a patient. Fused wire 20 (or fused wires 120, 220, 320 or other fused wires as discussed above) has wires 22*a*, 22*b* electrically coupled with medical device 400. For example, metal conductor wire 24*a* of wire 22*a* may be electrically coupled to the "positive" terminal of a power source of medical device 400, while metal conductor wire 24*b* of wire 22*b* may be electrically coupled to a "negative" terminal of the power source. At the other end of fused wire 20, wires 22*a* and 22*b* are separated along fusion line 28 so that metal conductor wires 24*a*, 24*b* may be connected to different portions of an anatomical structure. For example, medical device 400 may be a cardiac pacing device, with wires 22*a*, 22*b* coupled to the atrium and ventricle of a heart, respectively. Medical device 400 may also be a neurostimulation device, with wires 22*a*, 22*b* coupled to the spinal cord, cranial nerves, vagus nerves, or peripheral nerves, for example.

EXAMPLES

The following Examples illustrate various features and characteristics of the present invention, which is not to be construed as being limited thereto.

Example 1

Fusion of Wire Pairs Made from 316LVM, 35N LT®, and Pt/10% Ir Conductors Having ETFE Coatings In this Example, wire pairs were fused using the above-described apparatus. The wires had coatings formed from an ethylene tetrafluoroethylene copolymer (ETFE) and had outer diameters ($D_1$ and $D_2$) of 0.0121 inch (0.0307 cm). The spacing between the apexes 54 of grooves 52*a* and 52*b* of pulley 50, and the spacing between the apexes 60 of grooves 58*a* and 58*b* of pulley 56, were each 0.09 inch (0.2286 cm).

As set forth in Table 1 below, the wires had conductors made from 316LVM stainless steel, 35N LT® (an MP35N alloy available from Fort Wayne Metals Research Products Corporation of Fort Wayne, Ind.), and an alloy of 90% platinum/10% iridium (Pt10/Ir). Seven runs were conducted, each using two wires of the given construction and under the conditions set forth in Table 1 below. In each run, a laser micrometer measurement device was used to measure the combined or major diameter $D_3$ of the fused wire every second, with the average values of these measurements set forth in Table 1 below.

TABLE 1

| # | Conductor/ Coating | $D_1$ & $D_2$ (in/cm) | Temp (° F./° C.) | Speed (ft/min/cm/min) | Time @ temp (s) | Average $D_3$ (in/cm) | Reduction % | Fusion % |
|---|---|---|---|---|---|---|---|---|
| 1 | 316LVM/ ETFE | 0.0121/ 0.0307 | 490/ 254.4 | 2.4/ 73.2 | 14.583 | 0.023487/ 0.059657 | 2.943 | 97.057 |
| 2 | 316LVM/ ETFE | 0.01205/ 0.0306 | 500/ 260 | 3.5/ 106.7 | 10.714 | 0.023611/ 0.059972 | 2.028 | 97.972 |
| 3 | 316LVM/ ETFE | 0.0121/ 0.0307 | 500/ 260 | 3.5/ 106.7 | 9.999 | 0.023611/ 0.059972 | 2.433 | 97.567 |
| 4 | 316LVM/ ETFE | 0.0121/ 0.0307 | 500/ 260 | 4.0/ 121.9 | 8.75 | 0.023578/ 0.059888 | 2.569 | 97.432 |
| 5 | 316LVM/ ETFE | 0.01205/ 0.0306 | 500/ 260 | 4.0/ 121.9 | 9.375 | 0.023578/ 0.059888 | 2.164 | 97.836 |
| 6 | 316LVM/ ETFE | 0.01205/ 0.0306 | 500/ 260 | 4.0/ 121.9 | 9.375 | 0.023596/ 0.059934 | 2.092 | 97.909 |
| 7 | Pt10/Ir/ ETFE | 0.0121/ 0.0307 | 650/ 343.3 | 6.0/ 182.3 | 5.833 | 0.023613/ 0.059977 | 2.425 | 97.575 |
| 8 | 35N LT ®/ ETFE | 0.01205/ 0.0306 | 650/ 343.3 | 7.0/ 213.4 | 5.357 | 0.023798/ 0.060447 | 1.253 | 98.747 |
| 9 | 35N LT ®/ ETFE | 0.0121/ 0.0307 | 650/ 343.3 | 7.0/ 213.4 | 5 | 0.023798/ 0.060447 | 1.661 | 98.339 |
| 10 | Pt10/Ir/ ETFE | 0.01205/ 0.0306 | 650/ 343.3 | 6.0/ 182.3 | 6.25 | 0.023613/ 0.059977 | 2.020 | 97.980 |
| 11 | 316LVM/ ETFE | 0.01205/ 0.0306 | 650/ 343.3 | 9.0/ 274.3 | 4.167 | 0.023124/ 0.058735 | 4.050 | 95.950 |
| 12 | 316LVM/ ETFE | 0.01205/ 0.0306 | 650/ 343.3 | 9.5/ 289.6 | 3.947 | 0.023624/ 0.060005 | 1.974 | 98.027 |
| 13 | 316LVM/ ETFE | 0.01205/ 0.0306 | 650/ 343.3 | 10.1/ 307.8 | 3.713 | 0.02374/ 0.06030 | 1.495 | 98.505 |
| 14 | 316LVM/ ETFE | 0.01205/ 0.0306 | 650/ 343.3 | 10.3/ 313.9 | 3.641 | 0.02372/ 0.06025 | 1.576 | 98.424 |
| 15 | 316LVM/ ETFE | 0.01205/ 0.0306 | 650/ 343.3 | 10.5/ 320.0 | 3.571 | 0.023729/ 0.060272 | 1.540 | 98.460 |
| 16 | 316LVM/ ETFE | 0.0121/ 0.0307 | 720/ 382.2 | 10.0/ 304.8 | 3.5 | 0.023754/ 0.060335 | 1.841 | 98.159 |
| 17 | 316LVM/ ETFE | 0.01205/ 0.0306 | 720/ 382.2 | 11.0/ 335.3 | 3.409 | 0.023615/ 0.059982 | 2.015 | 97.985 |
| 18 | 316LVM/ ETFE | 0.01205/ 0.0306 | 720/ 382.2 | 11.2/ 341.4 | 3.348 | 0.023655/ 0.060084 | 1.758 | 98.242 |
| 19 | 316LVM/ ETFE | 0.01205/ 0.0306 | 720/ 382.2 | 11.5/ 350.5 | 3.261 | 0.023655/ 0.060084 | 1.847 | 98.153 |
| 20 | 316LVM/ ETFE | 0.0121/ 0.0307 | 720/ 382.2 | 12.0/ 365.8 | 2.917 | 0.023808/ 0.060472 | 1.622 | 98.378 |
| 21 | 316LVM/ ETFE | 0.01205/ 0.0306 | 720/ 382.2 | 12.0/ 365.8 | 3.125 | 0.023743/ 0.060307 | 1.480 | 98.520 |
| 22 | 316LVM/ ETFE | 0.01205/ 0.0306 | 720/ 382.2 | 12.2/ 371.8 | 3.074 | 0.023696/ 0.060188 | 1.675 | 98.325 |

Figure 11:
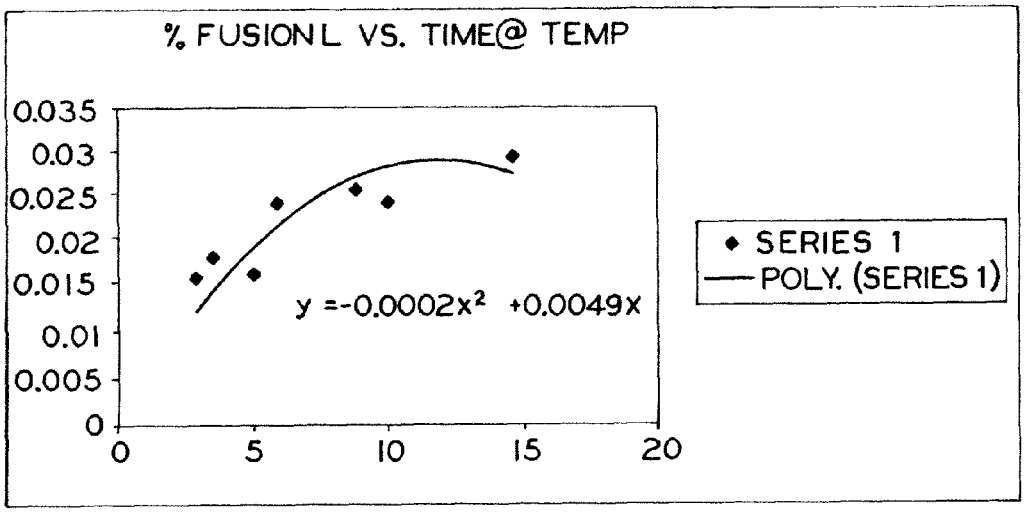
FIG. 11 is a plot of Reduction % vs. time at temperature for Example 1, along with a best fit curve.
Figure 12:
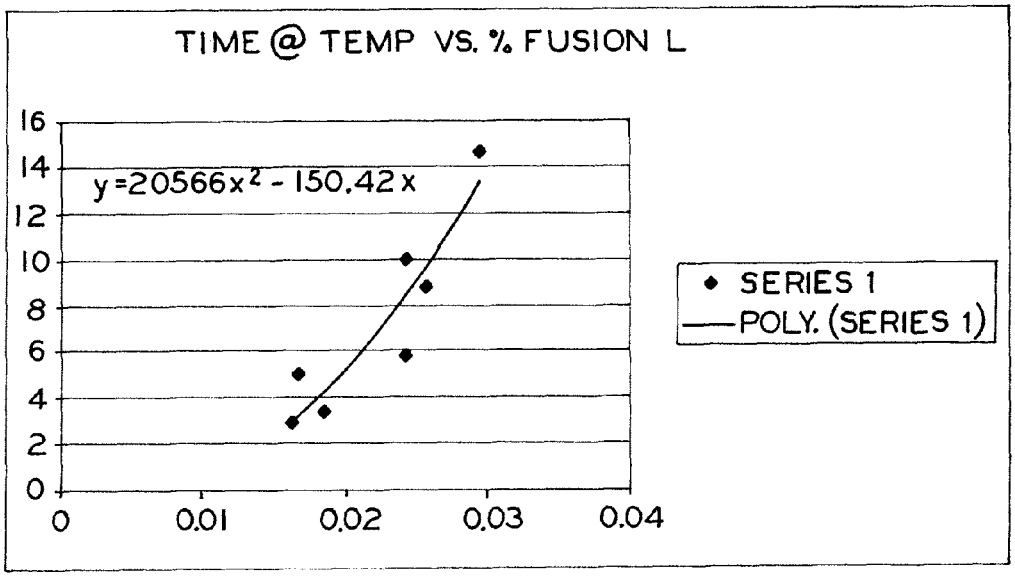
FIG. 12 is a plot of time at temperature vs. Reduction % for Example 1, along with a best fit curve.

Plots of Reduction % vs. time at temperature, and time at temperature vs. Reduction %, are set forth in FIGS. 11 and 12, respectively.

As set forth in FIG. 11, a best fit curve of the data reveals the following relationship:

$$\text{Reduction }\% = -0.002x^2 + 0.0049x,$$

where x=time at temperature. As set forth in FIG. 12, a best fit curve of the data reveals the following relationship:

$$y = 20566x^2 - 150.42x,$$

where x=Reduction % and y=time at temperature.

As illustrated in Table 1 and FIGS. 11 and 12, Fusion % was consistently between 97% and 98.5%, with the corresponding Reduction % between 1.5% and 3%. Thus, each of the seven fused wire samples tested in this example retained a substantial amount of the dimensional characteristics of their component wires, as discussed above.

This Example also illustrates that line speed may be increased with increasing heating chamber temperature or decreased with decreasing heating chamber temperature, while still maintaining consistent characteristics of the fused wire product produced. As shown above, the highest heating chamber temperatures (sample #'s 3 and 4) were 47% higher than the lowest heating chamber temperature (sample #5), with time at temperature between 3 and 4 times longer for the lowest heating chamber temperature as compared to the highest heating chamber temperature. Despite these substantial variations in production variables, however, Fusion % and Reduction % varied less than 2%.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fused wire, comprising:

a first wire including a first metal conductor surrounded by a first coating of cured fluoropolymer insulation, said first wire having a first diameter $D_1$ between 0.002 and 0.015 inches;

a second wire including a second metal conductor surrounded by a second coating of cured fluoropolymer insulation, said second wire having a second diameter $D_2$ between 0.002 and 0.015 inches; and said first and second wires fused together along a line contact between said first and second coatings to form said fused wire, said fused wire having a major diameter $D_3$, said fused wire further having a value Fusion % according to the following formula:

$$\text{Fusion }\% = [D_3/(D_1+D_2)]\times 100\% \quad \text{(I)}$$

wherein Fusion % is between 90% and 99.5% and wherein said first wire comprises a first cross-sectional size, said second wire comprises a second cross-sectional size, said first cross-sectional size different from said second cross-sectional size.

2. The fused wire of claim 1, wherein Fusion % is between 90% and 97%.

3. The fused wire of claim 1, wherein Fusion % is between 95% and 99%.

4. The fused wire of claim 1, wherein at least one of said first metal conductor and said second metal conductor comprises one of a single-strand wire and a multi-strand wire.

5. The fused wire of claim 1, wherein at least one of said first coating of insulation and said second coating of insulation comprises an extruded fluoropolymer.

6. The fused wire of claim 1, wherein Fusion % is at least 97%.

7. The fused wire of claim 1, wherein said line contact comprises a continuous fusion line, whereby integrity of said first coating of insulation and said second coating of insulation is maintained along said continuous fusion line.

8. The fused wire of claim 1, wherein said fluoropolymer comprises one of polytetrafluoroethylene (PTFE), methyl fluoro alkoxy (MFA), fluoro ethylene propylene (FEP), perfluoro alkoxy (PFA), poly(chlorotrifluoroethylene), poly(vinylfluoride), co-polymers of tetrafluoroethlyene and ethylene (ETFE), polyvinylidene fluoride (PVDF), and co-polymers of tetrafluoroethylene, hexafluoropropylene, and vinylidene difluoride (THV).

9. The fused wire of claim 1, wherein said first coating of insulation and said second coating of insulation comprise the only coating over said first wire and said second wire, respectively.

10. The fused wire of claim 1, wherein said first diameter $D_1$ and said second diameter $D_2$ respectively include a thickness of said first coating of insulation and said second coating of insulation between 0.00075 inches to 0.003 inches.

11. A fused wire, comprising:

a wire including a first metal conductor surrounded by a first coating of cured fluoropolymer insulation, said wire having a first diameter $D_1$ between 0.002 and 0.015 inches;

a ribbon including a second metal conductor surrounded by a second coating of cured fluoropolymer insulation, said ribbon having a width $D_2$ between 0.002 and 0.015 inches; and said wire and said ribbon fused together along a line contact between said first and second coatings to form said fused wire, said fused wire having a major diameter $D_3$, said fused wire further having a value Fusion % according to the following formula:

$$\text{Fusion }\% = [D_3/(D_1+D_2)]\times 100\% \quad \text{(I)}$$

wherein Fusion % is between 90% and 99.5%.

12. The fused wire of claim 11, wherein at least one of said first coating of insulation and said second coating of insulation comprises an extruded fluoropolymer.

13. The fused wire of claim 11, wherein Fusion % is at least 97%.

14. The fused wire of claim 11, wherein said line contact comprises straight line contact.

15. The fused wire of claim 11, wherein said first diameter $D_1$ and said width $D_2$ respectively include a thickness of said first coating of insulation and said second coating of insulation between 0.00075 inches to 0.003 inches.

16. A fused wire, comprising:

a first wire including a first metal conductor surrounded by a first coating of cured fluoropolymer insulation, said first wire having a first diameter $D_1$ between 0.002 and 0.015 inches;

a second wire including a second metal conductor surrounded by a second coating of cured fluoropolymer insulation, said second wire having a second diameter $D_2$ between 0.002 and 0.015 inches; and said first and second wires fused together along a line contact between said first and second coatings to form said fused wire, said fused wire having a major diameter $D_3$, said fused wire further having a value Fusion % according to the following formula:

$$\text{Fusion }\% = [D_3/(D_1+D_2)]\times 100\% \quad \text{(I)}$$

wherein Fusion % is between 90% and 99.5% and wherein said first coating of insulation has a first thickness, said second coating of insulation has a second thickness, said first thickness different from said second thickness.

17. The fused wire of claim 16, wherein:

at least one of said first coating of insulation and said second coating of insulation comprises an extruded fluoropolymer; and said line contact comprises a continuous line of chemical bonds formed between said first coating of insulation and said second coating of insulation.

18. The fused wire of claim 16, wherein Fusion % is at least 97%.

19. The fused wire of claim 16, wherein at least one of said first wire and said second wire comprises a multi-strand wire formed of a plurality of individual metal wires.

20. The fused wire of claim 16, wherein said first thickness of said first coating of insulation and said second thickness of said second coating of insulation are each between 0.00075 inches to 0.003 inches.

21. The fused wire of claim 16, wherein said first coating of insulation and said second coating of insulation comprise the only coating over said first wire and said second wire, respectively.

* * * * *